US011499441B2

(12) United States Patent
Seki

(10) Patent No.: US 11,499,441 B2
(45) Date of Patent: Nov. 15, 2022

(54) COMPRESSOR STATOR VANE UNIT, COMPRESSOR, AND GAS TURBINE

(71) Applicant: MITSUBISHI HEAVY INDUSTRIES, LTD., Tokyo (JP)

(72) Inventor: Ryosuke Seki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 16 days.

(21) Appl. No.: 16/787,405

(22) Filed: Feb. 11, 2020

(65) Prior Publication Data

US 2020/0325787 A1 Oct. 15, 2020

(30) Foreign Application Priority Data

Apr. 10, 2019 (JP) ..... JP2019-075188

(51) Int. Cl.
*F01D 11/00* (2006.01)
*F01D 9/04* (2006.01)
(Continued)

(52) U.S. Cl.
CPC ..... *F01D 11/001* (2013.01); *F01D 9/041* (2013.01); *F01D 11/02* (2013.01); *F04D 29/324* (2013.01);
(Continued)

(58) Field of Classification Search
CPC ..... F01D 11/00; F01D 11/001; F01D 11/02; F01D 9/02; F01D 9/04; F01D 9/041;
(Continued)

(56) References Cited

U.S. PATENT DOCUMENTS 10,539,032 B2 1/2020 Soni et al.
2006/0120864 A1* 6/2006 Lu ..... F01D 25/246 415/191
(Continued)

FOREIGN PATENT DOCUMENTS

| | | |
|---|---|---|
| CN | 106907188 | 6/2017 |
| JP | 2006-233787 | 9/2006 |
| JP | 5651459 | 1/2015 |

OTHER PUBLICATIONS

Office Action dated Aug. 9, 2021 in Chinese Patent Application No. 202010100637.3, with English-language translation.

*Primary Examiner* — Eldon T Brockman
*Assistant Examiner* — Elton K Wong
(74) *Attorney, Agent, or Firm* — Wenderoth, Lind & Ponack, LLP

(57) ABSTRACT

A compressor stator vane unit includes multiple compressor stator vanes disposed at a certain interval in a circumferential direction; and an annular joint member connected with inner ends of the multiple compressor stator vanes; wherein the annular joint member constitutes an outer diameter side surface of a leakage fluid flow path provided in an inner diameter side of the joint member to communicate a high-pressure space with a low-pressure space respectively located downstream and upstream of the multiple compressor stator vanes in a fluid flow direction, and D/P is set to $0.05 \leq D/P \leq 0.2$, wherein D is defined as a distance in an axial direction between an upstream end surface of the annular joint member and an upstream edge of the multiple compressor stator vanes in the fluid flow direction and P is defined as a pitch between the adjacent compressor stator vanes in the circumferential direction.

7 Claims, 4 Drawing Sheets

(51) Int. Cl.
*F01D 11/02* (2006.01)
*F04D 29/32* (2006.01)

(52) U.S. Cl.
CPC ..... *F05D 2240/12* (2013.01); *F05D 2240/30* (2013.01); *F05D 2240/35* (2013.01); *F05D 2240/55* (2013.01); *F05D 2240/80* (2013.01)

(58) Field of Classification Search
CPC ..... F01D 9/042; F04D 29/32; F05D 2240/12; F05D 2240/121; F05D 2240/30; F05D 2240/35; F05D 2240/55; F05D 2240/80
See application file for complete search history.

(56) References Cited

U.S. PATENT DOCUMENTS

2007/0059159 A1* 3/2007 Hjerpe ..... B08B 3/02 415/117
2008/0310961 A1* 12/2008 Guemmer ..... F01D 5/225 416/189
2011/0158797 A1 6/2011 Chiu et al.
2015/0354365 A1* 12/2015 Balzer ..... F01D 5/186 416/95
2016/0160670 A1* 6/2016 Aggarwala ..... F01D 9/041 415/122.1
2017/0175556 A1 6/2017 Soni et al.
2018/0209337 A1* 7/2018 Russo ..... F25J 1/0209

* cited by examiner

COMPRESSOR STATOR VANE UNIT, COMPRESSOR, AND GAS TURBINE

CROSS-REFERENCE TO RELATED APPLICATIONS

The present application claims priority to and incorporates by reference the entire contents of Japanese Patent Application No. 2019-075188 filed in Japan on Apr. 10, 2019.

FIELD

The present invention relates to a compressor stator vane unit including compressor stator vanes disposed at certain intervals in a circumferential direction, a compressor including the compressor stator vane unit, and a gas turbine including the compressor.

BACKGROUND

A gas turbines includes a compressor, a combustor, and a turbine. The compressor includes a plurality of compressor stator vanes and a plurality of compressor rotor blades that are alternately arranged in a casing. The compressor stator vanes are disposed at certain intervals in a circumferential direction and outer ends of the compressor stator vanes are fixed to an inner circumferential surface of the casing. The compressor rotor blades are disposed at certain intervals in the circumferential direction and inner ends of the compressor rotor blades are fixed to an outer circumference of a rotor that is rotatably supported by the casing. Inner ends of the compressor stator vanes are fixed to an annular shroud. A seal member is provided between the shroud and the rotor.

The compressor compresses air taken from an air intake to generate high-temperature and high-pressure compressed air. The pressure of the air increases as the air flows downstream in an air flow direction. The compressed air having a higher pressure at a downstream side of the compressor stator vanes tends to flow into the compressed air having a lower pressure at an upstream side of the compressor stator vanes through a cavity provided between the shroud and the rotor. Although the seal member is provided, it is difficult to completely eliminate a leakage of the compressed air. If the compressed air leaks from the downstream side to the upstream side of the compressor stator vanes through the cavity and mixes with a main flow of the compressed air, a secondary flow is generated and pressure loss occurs.

Conventional techniques for solving the problem above are disclosed in, for example, Japanese Patent Application Laid-open No. 2006-233787 and Japanese Patent No. 5651459.

Conventional compressors described in the references noted above include a swirler or tangential flow inducers provided in a leakage flow path of the compressed air. However, this configuration may increase structural complexity and manufacturing cost.

SUMMARY OF THE INVENTION

The present invention has been made in view of the foregoing, and it is an object of the present invention to provide a compressor stator vane unit, a compressor, and a gas turbine that prevent leakage fluid from flowing out without increasing the structural complexity or the manufacturing cost, and prevent pressure loss.

Solution to Problem

According to one aspect of the present invention, there is provided a compressor stator vane unit comprising: multiple compressor stator vanes disposed at a certain interval in a circumferential direction; and an annular joint member connected with inner ends of the multiple compressor stator vanes; wherein the annular joint member constitutes an outer diameter side surface of a leakage fluid flow path which is provided in an inner diameter side of the joint member and which communicates a high-pressure space located downstream of the multiple compressor stator vanes in a fluid flow direction with a low-pressure space located upstream of the multiple compressor stator vanes in the fluid flow direction, and D/P is set to a range: $0.05 \leq D/P \leq 0.2$, wherein D is defined as a distance in an axial direction between an upstream end surface of the annular joint member in the fluid flow direction and an upstream edge of the multiple compressor stator vanes in the fluid flow direction, and P is defined as a pitch between the adjacent compressor stator vanes in the circumferential direction.

Setting a relation between the distance D which is in the axial direction between the opening of the leakage fluid flow path close to the low-pressure space and the upstream edge of the compressor stator vanes and the pitch P between the compressor stator vanes in the circumferential direction to an appropriate range can prevent interference between the main fluid flow and the leakage fluid and can prevent generation of a secondary flow, when the fluid in the high-pressure space leaks into the low-pressure space through the leakage fluid flow path. Therefore, the compressor stator vane unit can prevent leakage fluid from flowing out without increasing the structural complexity or the manufacturing cost, and can prevent pressure loss.

According to one aspect of the present invention, there is provided the compressor stator vane unit described above, wherein D/P is set to a range: $0.06 \leq D/P \leq 0.18$.

This configuration can effectively prevent the interference between the main fluid flow and the leakage fluid and can prevent the generation of the secondary flow when the fluid in the high-pressure space leaks into the low-pressure space through the leakage fluid flow path.

According to one aspect of the present invention, there is provided a compressor stator vane unit comprising: multiple compressor stator vanes disposed at a certain interval in a circumferential direction; and an annular joint member connected with inner ends of the multiple compressor stator vanes; wherein the annular joint member constitutes an outer diameter side surface of a leakage fluid flow path which is provided in an inner diameter side of the joint member and which communicates a high-pressure space located downstream of the multiple compressor stator vanes in a fluid flow direction with a low-pressure space located upstream of the multiple compressor stator vanes in the fluid flow direction, and D/T is set to a range: $0.3 \leq D/T \leq 1.2$, wherein D is defined as a distance in an axial direction between an upstream end surface of the annular joint member in the fluid flow direction and an upstream edge of the multiple compressor stator vanes in the fluid flow direction, and T is defined as a maximum thickness of each of the multiple compressor stator vanes, D/T is set to a range: $0.3 \leq D/T \leq 1.2$.

Setting the relation between the distance D which is in the axial direction between the opening of the leakage fluid flow path close to the low-pressure space and the upstream edge of the compressor stator vanes and the maximum thickness of the compressor stator vane T to the appropriate range can prevent interference between the main fluid flow and the leakage fluid and can prevent generation of a secondary flow, when the fluid in the high-pressure space leaks into the low-pressure space through the leakage fluid flow path. Therefore, the compressor stator vane unit can prevent leakage fluid from flowing out without increasing the structural complexity or the manufacturing cost, and can prevent pressure loss.

According to one aspect of the present invention, the compressor stator vane unit described above satisfies a relationship in which D/T is set to a range: $0.4 \leq D/T \leq 1.1$.

This configuration can effectively prevent the interference between the main fluid flow and the leakage fluid and can prevent the generation of the secondary flow when the fluid in the high-pressure space leaks into the low-pressure space through the leakage fluid flow path.

According to one aspect of the present invention, there is provided a compressor comprising: a casing; a rotation shaft disposed in and rotatably supported by the casing; the multiple compressor stator vane units described above, the compressor stator vane units being fixed to an inner circumferential surface of the casing at a certain interval in the axial direction of the rotation shaft; and multiple compressor rotor blade units fixed to an outer circumference of the rotation shaft at a certain interval in the axial direction and each of the multiple compressor rotor blade units includes multiple compressor rotor blades fixed to the outer circumference of the rotation shaft at a certain interval in a circumferential direction.

The compressor can prevent the leakage fluid from flowing out without increasing the structural complexity or the manufacturing cost, and can prevent the pressure loss.

According to one aspect of the present invention, there is provided a gas turbine comprising: the compressor described above; a combustor configured to mix compressed air compressed by the compressor with a fuel to burn the mixture; and a turbine rotationally driven by combustion gas generated by the combustor.

The gas turbine can prevent the leakage fluid from flowing out without increasing the structural complexity or the manufacturing cost, and can prevent the pressure loss.

According to one aspect of the present invention, there is provided the gas turbine described above, wherein a rated speed of the gas turbine is set to a range from 2500 rpm to 4000 rpm.

The gas turbine on operating at a rated speed can effectively prevent the interference between the main fluid flow and the leakage fluid and can prevent the generation of the secondary flow when the fluid in the high-pressure space leaks into the low-pressure space through the leakage fluid flow path.

According to one aspect of the present invention, there is provided the gas turbine described above, wherein a velocity of fluid flowing in the axial direction through a region between the compressor stator vanes at a rated speed range is set to a range from 50 m/s to 200 m/s.

The gas turbine on operating at the rated speed can effectively prevent the interference between the main fluid flow and the leakage fluid and can prevent the generation of the secondary flow when the fluid in the high-pressure space leaks into the low-pressure space through the leakage fluid flow path.

The compressor stator vane unit, the compressor, and the gas turbine according to the present invention can prevent the leakage fluid from flowing out without increasing the structural complexity or the manufacturing cost, and can prevent the pressure loss.

DESCRIPTION OF EMBODIMENT

The following describes a preferred embodiment of a compressor stator vane unit, a compressor, and a gas turbine according to the present invention with reference to the accompanying drawings. The embodiment is not presented to limit the scope of the present invention. If there are a plurality of embodiments, combinations of the embodiments are also included in the scope of the present invention.

Figure 1:
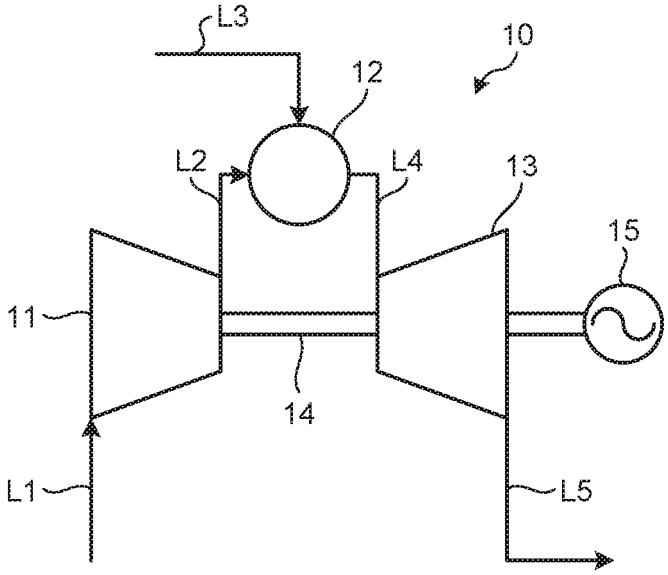
FIG. 1 is a schematic diagram illustrating a general configuration of a gas turbine according to an embodiment of the present invention.

FIG. 1 is a schematic diagram illustrating a general configuration of a gas turbine according to the present embodiment.

In the present embodiment, as illustrated in FIG. 1, the gas turbine 10 includes a compressor 11, a combustor 12, and a turbine 13. The compressor 11 is integrally and rotatably connected with the turbine 13 by a rotor (rotation shaft) 14, and the rotor 14 is connected with a generator 15. The compressor 11 is connected with an air intake line L1 and a compressed air feed line L2. The combustor 12 is connected with the compressed air feed line L2 and a fuel gas feed line L3. The combustor 12 is connected with the turbine 13 via a combustion gas feed line L4. The turbine 13 is connected with an exhaust gas line L5.

In the gas turbine 10, the compressor 11 compresses air taken from the air intake line L1, and the combustor 12 mixes the compressed air supplied from the compressed air feed line L2 with fuel gas supplied from the fuel gas feed line L3 and burns the mixture. The turbine 13 is rotationally driven by the combustion gas supplied from the combustion gas feed line L4, and then the generator 15 generates power. Flue gas emitted from the turbine 13 is discharged through the exhaust gas line L5.

Figure 2:
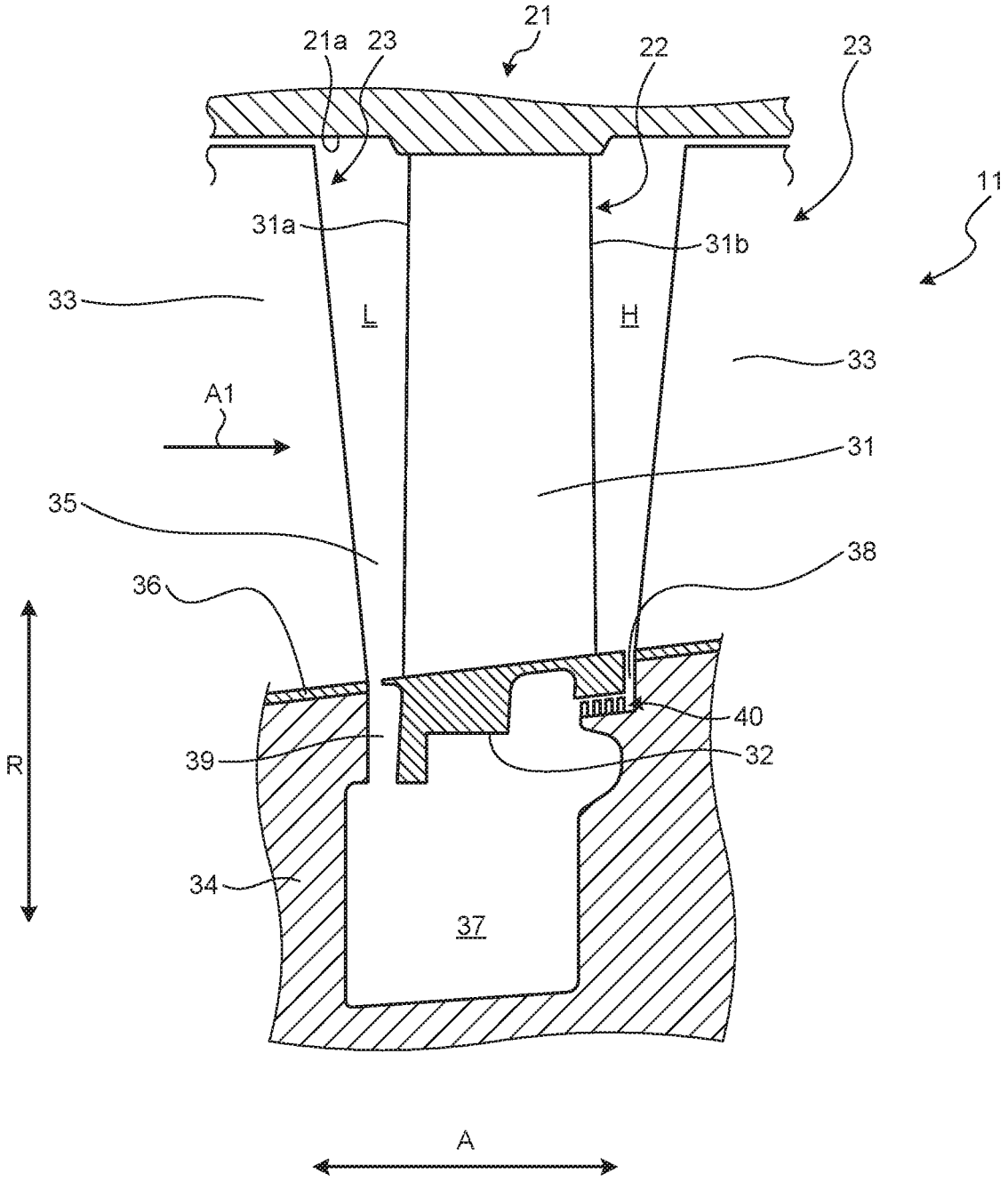
FIG. 2 is a sectional view illustrating a main part of a compressor according to the embodiment.

FIG. 2 is a sectional view illustrating a main part of the compressor according to the present embodiment.

As illustrated in FIGS. 1 and 2, the compressor 11 includes a casing 21, the rotor 14, multiple compressor stator vane units 22, and multiple compressor rotor blade units 23. The rotor 14 is disposed in and rotatably supported by the casing 21. The multiple compressor stator vane units 22 are disposed at a certain interval in an axial direction A of the rotor 14. Each of the compressor stator vane units 22 includes multiple compressor stator vanes 31 disposed at a certain interval in a circumferential direction. Outer ends of the compressor stator vanes 31 in a radial direction R are fixed to an inner circumferential surface 21*a* of the casing 21. Inner ends of the compressor stator vanes 31 in the radial direction R are connected with an annular shroud (annular joint member) 32.

The multiple compressor rotor blade units 23 are disposed at a certain interval in the axial direction A of the rotor 14. The multiple compressor rotor blade units 23 and the multiple compressor stator vane units 22 are alternately arranged in the axial direction A of the rotor 14. Each of the compressor rotor blade rotor units 23 includes multiple compressor rotor blades 33 disposed at a certain interval in the circumferential direction. Inner ends of the compressor rotor blades 33 in the radial direction R are fixed to an outer circumference of a disk 34 fixed to the rotor 14. The multiple compressor rotor blades 33 extend in the radial direction R and their outer ends are located close to the inner circumferential surface 21*a* of the casing 21.

In this structure, a first one of the compressor rotor blades 33 is disposed at a first (upstream) side of one of the compressor stator vanes and a second one of the compressor rotor blades 33 is disposed at the a second (downstream) side of the same one of the compressor stator vanes 31 in the axial direction A of the rotor 14. In other words, the first one of the compressor rotor blades 33 at the first side is disposed adjacent to an upstream side of the respective one of the compressor stator vanes 31 in an air flow direction A1 of a main gas flow path 35, and the second one of the compressor rotor blades 33 at the second side is disposed adjacent to a downstream side of the same one of the compressor stator vanes 31 in the air flow direction A1 of the main gas flow path 35. The main gas flow path 35 is defined by the inner circumferential surface 21*a* of the casing 21, the shroud 32 of the compressor stator vanes 31, and platforms 36 of the compressor rotor blades 33.

A cavity 37 is formed between the shroud 32 of the compressor stator vanes 31 and the disk 34. That is, the shroud 32 of the compressor stator vanes 31 constitutes an outer diameter side surface of the cavity 37. A first leakage air flow path 38 is provided between the compressor stator vanes 31 and the compressor rotor blades 33 at the other side. The first leakage air flow path 38 allows the main gas flow path 35 to communicate with the cavity 37. A second leakage air flow path 39 is provided between the same compressor stator vanes 31 and the compressor rotor blades 33 at the one side. The second leakage air flow path 39 allows the main gas flow path 35 to communicate with the cavity 37. The first leakage air flow path 38 communicates with the cavity 37 at a downstream side of a trailing edge 31*b* of the compressor stator vanes 31 in the air flow direction A1, and the second leakage air flow path 39 is communicated with the cavity 37 at an upstream side of a leading edge 31*a* of the same compressor stator vanes 31 in the air flow direction A1. A leakage fluid flow path according to the present invention is provided close to a center of the shroud 32 (rotor 14), that is, an inner diameter side of the shroud 32, and includes the cavity 37, the first leakage air flow path 38 and the second leakage air flow path 39. The first leakage air flow path 38 is provided with a labyrinth seal (seal member) 40. The labyrinth seal 40 provides a seal to the first leakage air flow path 38 to prevent the compressed air in the main gas flow path 35 close to the trailing edge 31*b* of the compressor stator vanes 31 from flowing into the cavity 37.

The compressor 11 takes air from an air intake (not illustrated) and compresses the air while the air is passing through the multiple compressor stator vane units 22 and the multiple compressor rotor blade units 23 that are alternately arranged to generate high-temperature and high-pressure compressed air. The compressed air in a high-pressure space H located downstream in the air flow direction A1 leaks through the first leakage air flow path 38, the cavity 37, and the second leakage air flow path 39 into a low-pressure space L located upstream in the air flow direction A1. Although the first leakage air flow path 38 is provided with the labyrinth seal 40, a small amount of compressed air tends to leak. When this leakage air mixes with the compressed air flowing in the main gas flow path 35, it generates a secondary flow and causes pressure loss.

Figure 3:
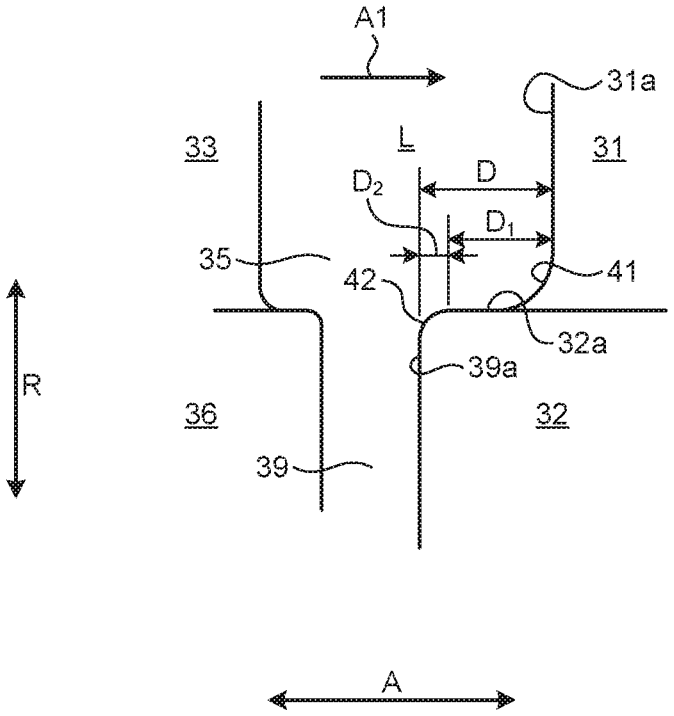
FIG. 3 is a schematic side view illustrating a relation between a leakage air flow path and compressor stator vanes.

In the present embodiment, the secondary flow is prevented from being generated by providing the second leakage air flow path 39 that communicates with the low-pressure space L in the main gas flow path 35 at an optimal position, and thus the pressure loss is prevented from being generated. FIG. 3 is a schematic side view illustrating a relation between the leakage air flow path and the compressor stator vanes, and FIG. 4 is a schematic plan view illustrating a relation between the leakage air flow path and the compressor stator vanes.

Figure 4:
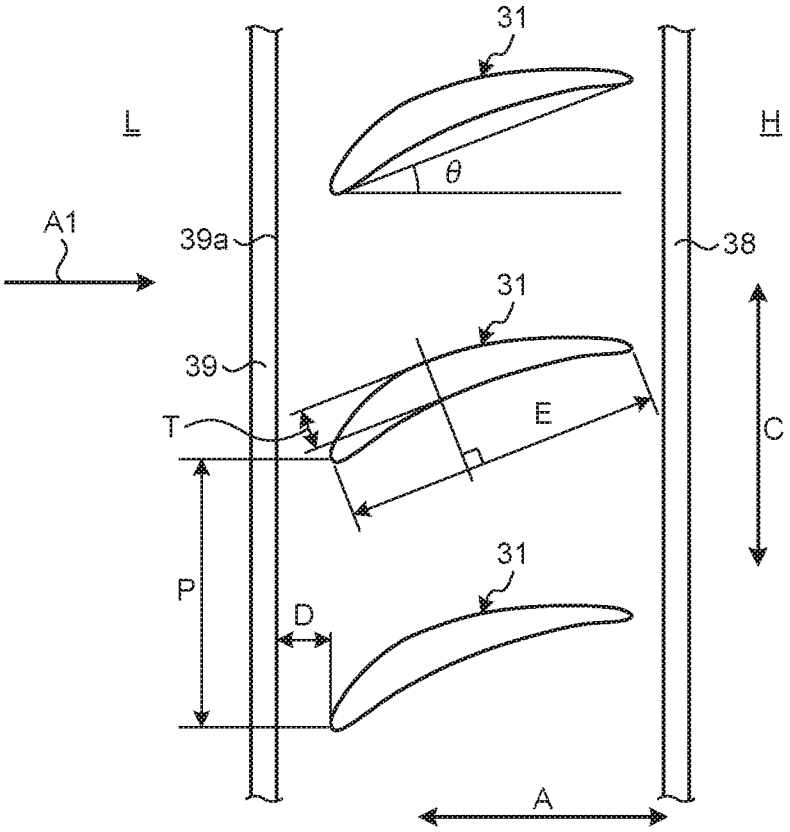
FIG. 4 is a schematic plan view illustrating a relation between the leakage air flow path and the compressor stator vanes.

In the present embodiment, as illustrated in FIGS. 3 and 4, assume that a distance in the axial direction A between an opening of the second leakage air flow path 39 close to the low-pressure space L and the leading edge (edge) 31*a* of the compressor stator vanes 31 located upstream in the air flow direction A1 is defined as D (hereinafter referred to as an opening distance D), and a pitch between the compressor stator vanes 31 in the circumferential direction C is defined as P (hereinafter referred to as a compressor stator vane pitch P). In this case, a ratio of the opening distance D to the compressor stator vane pitch P, or D/P, is set to the following range:

$$0.05 \leq D/P \leq 0.2.$$

It is preferred that the ratio of the opening distance D to the compressor stator vane pitch P, or D/P, is narrowed to the following range:

$$0.06 \leq D/P \leq 0.18.$$

Assume that a maximum thickness of the compressor stator vanes 31 is defined as T (hereinafter referred to as a compressor stator vane maximum thickness T). In this case, a ratio of the opening distance D to the compressor stator vane maximum thickness T, or D/T, is set to the following range:

$$0.3 \leq D/T \leq 1.2.$$

It is preferred that the ratio of the opening distance D to the compressor stator vane maximum thickness T, or D/T, is narrowed to the following range:

$$0.4 \leq D/T \leq 1.1.$$

The opening distance D is, specifically, a distance in the axial direction A between an end surface 39*a* of the second leakage air flow path 39 located downstream in the air flow direction A1, which corresponds to an upstream end surface of the shroud 32 in the air flow direction A1, and the leading edge 31*a* of the compressor stator vanes 31 at a position at which the second leakage air flow path 39 communicates with the main gas flow path 35. A curved portion 41 is provided between the leading edge 31*a* of the compressor stator vane 31 and the outer surface 32*a* of the shroud 32. A curved portion 42 is provided between the outer surface 32*a* of the shroud 32 and the end surface 39*a* of the second leakage air flow path 39. Assume that a distance in the axial direction A from a boundary between the outer surface 32*a* of the shroud 32 and the curved portion 42 to a boundary between the leading edge 31*a* of the compressor stator vanes 31 and the curved portion 41 is defined as D1, and a distance in the axial direction A from the end surface 39*a* of the second air flow path 39 to the boundary between the outer surface 32*a* of the shroud 32 and the curved portion 42, that is, a distance of the curved portion 42 in the axial direction A, is defined as D2. In this case, a relation between the opening distance D and the distance D2 can be written as follows:

$$0.2 \leq D2/D \leq 1.0.$$

The multiple compressor stator vanes 31 are disposed at a certain regular interval in the circumferential direction C. The compressor stator vane pitch P is, specifically, a length between two adjacent compressor stator vanes 31 in the circumferential direction C at a position closest to the shroud 32, and more specifically, at a position of the boundary between the leading edge 31*a* of the compressor stator vanes 31 and the curved portion 41. The compressor stator vane maximum thickness T is, specifically, a thickness of a compressor stator vane 31 at a position closest to the shroud 32, and more specifically, at a position of the boundary between the leading edge 31*a* of the compressor stator vane 31 and the curved portion 41. In this case, the compressor stator vane maximum thickness T is a thickness of the compressor stator vane 31 in a direction orthogonal to the direction of a chord length E of the compressor stator vane 31. A relation between the opening distance D and the chord length E can be written as follows:

$$2D \leq E \leq 250D.$$

It should be noted that an angle θ between a direction of the chord length E and the axial direction A is set to a range: 10 degrees≤θ≤80 degrees.

When the leakage air flowing out from the second leakage air flow path 39 mixes with the main flow of the compressed air in the low-pressure space L of the main gas flow path 35, the leakage air typically generates the secondary flow and causes the pressure loss. However, the opening (end surface 39*a*) of the second leakage air flow path 39 is disposed at an optimal position relative to the leading edge 31*a* of the compressor stator vanes 31, and this configuration prevents generation of the secondary flow and the pressure loss.

Figure 5:
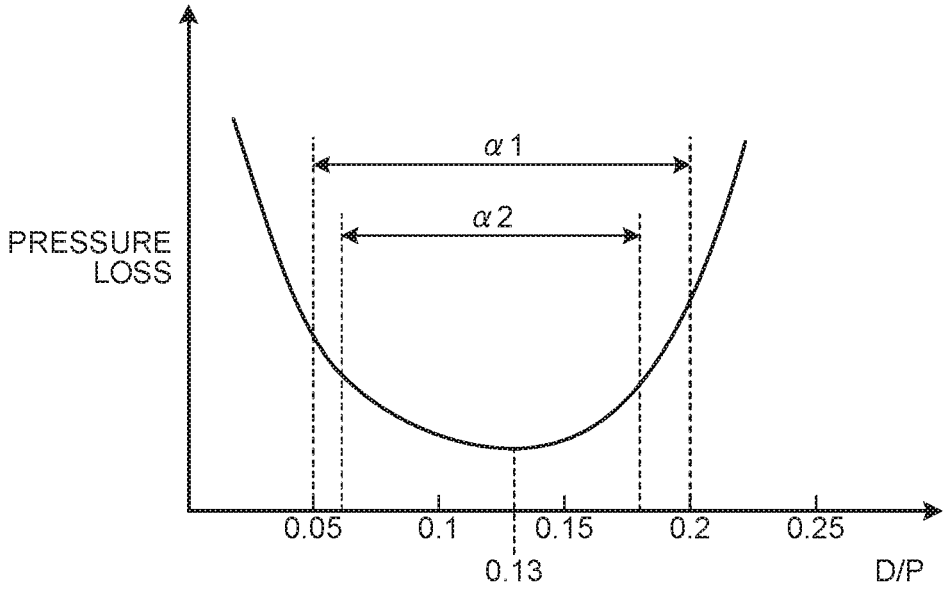
FIG. 5 is a graph illustrating pressure loss relative to D/P.
Figure 6:
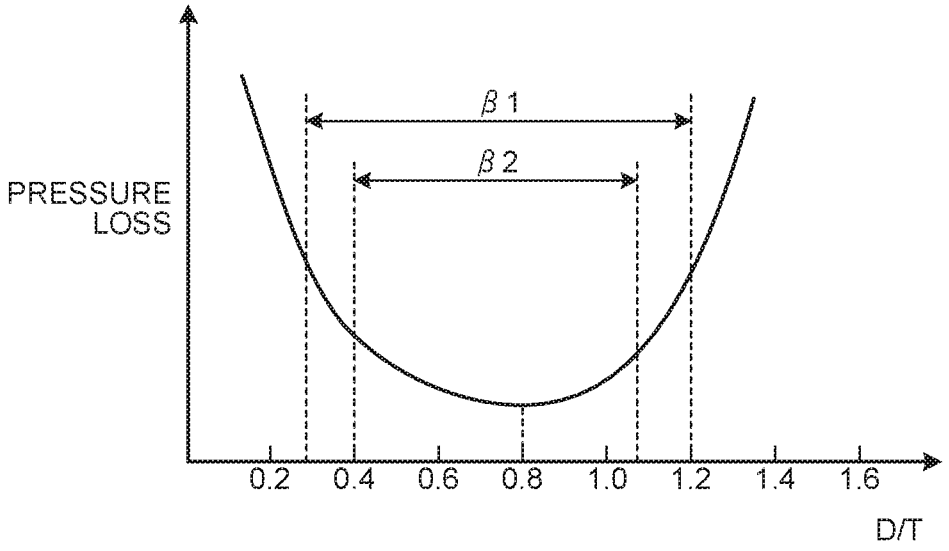
FIG. 6 is a graph illustrating pressure loss relative to D/T.

FIG. 5 is a graph illustrating the pressure loss relative to D/P, and FIG. 6 is a graph illustrating the pressure loss relative to D/T. Data of the pressure loss illustrated in FIGS. 5 and 6 is measured when the gas turbine 10 is operated at a rated speed range ranging from 2500 rpm to 4000 rpm. More specifically, the data of the pressure loss illustrated in FIGS. 5 and 6 is measured when the gas turbine 10 is operated at the rated speed range and having a velocity of air flowing in the axial direction through a region between the compressor stator vanes 31 ranging from 50 m/s to 200 m/s.

As illustrated in FIG. 5, the pressure loss is smallest when the ratio of the opening distance D to the compressor stator vane pitch P, or D/P, is 0.13, and the pressure loss increases as D/P decreases or increases from 0.13. It is preferred that the ratio D/P is set to a range α1 of 0.05≤D/P≤0.2, and more preferably, set to a range α2 of 0.06≤D/P≤0.18. Due to a lower pressure at the back side and a higher pressure at the front side of the compressor stator vanes 31, a pressure differential in the circumferential direction is generated at the leading edge 31*a*. Therefore, when the ratio D/P is smaller than 0.05, the pressure differential will easily act upon the opening of the second leakage air flow path 39, and the secondary flow is more likely to occur and causes the pressure loss. When the ratio D/P is larger than 0.2, the pressure differential is less likely to act upon the opening of the second leakage air flow path 39 but the pressure loss increases due to a larger outer surface of the shroud 32 close to the leading edge 31*a* of the compressor stator vanes 31. In particular, when the ratio D/P is out of the range α1, the pressure loss increases significantly. When the ratio D/P is out of the range α2, the pressure loss is equal to or larger than two times or more of the smallest pressure loss at the ratio D/P of 0.13. In the present embodiment, analytical models are used to calculate the pressure loss occurring between the compressor stator vane inlet and the compressor stator vane outlet in a range of 20% of a height from a platform to a tip of the compressor stator vane with a full length of the compressor stator vane being 100%.

As illustrated in FIG. 6, when the ratio of the opening distance D to the compressor stator vane maximum thickness T, or D/T, is 0.8, the pressure loss is smallest, and when the ratio D/T is larger than 0.8, the pressure loss increases due to an increase of a flow area. When the ratio D/T is smaller than 0.8, the leading edge 31*a* of the compressor stator vanes 31 becomes close to the opening 39, and the leakage is induced due to an effect of a potential field of the compressor stator vane, and thus the pressure loss increases. It is preferred that the ratio D/T is set to a range β1 of 0.3≤D/T≤1.2, and more preferably, to a range β2 of 0.4≤D/T≤1.1.

In the compressor stator vane unit according to the present embodiment, when the distance in the axial direction A between the opening of the second leakage air flow path 39 close to the low-pressure space L and the leading edge 31*a* of the compressor stator vanes 31 located upstream in the air flow direction A1 is D, and when the pitch between the compressor stator vanes 31 in the circumferential direction C is P, the ratio D/P is set to 0.05≤D/P≤0.2. In this case, it is preferred that the ratio D/P is set to 0.06≤D/P≤0.18.

Setting the ratio of the opening distance D to the compressor stator vane pitch P, or D/P, to a suitable range can prevent the interference between the main flow of the compressed air and the leakage air and can prevent the generation of the secondary flow, when the air in the high-pressure space H leaks through the first leakage air flow path 38, the cavity 37, and the second leakage air flow path 39 into the low-pressure space L. This configuration can prevent the leakage air from flowing out without increasing the structural complexity or the manufacturing cost, and can prevent the pressure loss.

In the compressor stator vane unit according to the present embodiment, when the distance in the axial direction A between the opening of the second leakage air flow path 39 close to the low-pressure space L and the leading edge 31*a* of the compressor stator vanes 31 located upstream in the air flow direction A1 is D, and when the maximum thickness of the compressor stator vanes 31 is T, the ratio D/T is set in the range β1 of 0.3≤D/T≤1.2. In this case, it is preferred that the ratio D/T is set in the range β2 of 0.4≤D/T≤1.1. When the ratio D/T is out of the range β1, the pressure loss increases significantly, and thus it is preferred that the ratio D/T is set in the range β1. When the ratio D/T is set in the range β2, the pressure loss is approximately smaller than two times or more of the smallest pressure loss at D/T=0.8.

Setting the ratio of the opening distance D to the maximum thickness T, or D/T, to an appropriate range can prevent the interference between the main flow of the compressed air and the leakage air and can prevent the generation of the secondary flow, when the air in the high-pressure space H leaks through the first leakage air flow path 38, the cavity 37, and the second leakage air flow path 39 into the low-pressure space L. This configuration can prevent the leakage air from flowing out without increasing the structural complexity or the manufacturing cost, and can prevent the pressure loss.

The compressor according to the present embodiment includes the casing 21, the rotor 14 disposed in and rotatably supported by the casing 21, the multiple compressor stator vane units 22 fixed to the inner circumferential surface 21*a* of the casing 21 at a certain interval in the axial direction A of the rotor 14, and the multiple compressor rotor blade units 23 including the multiple compressor rotor blades 33 fixed to the outer circumference of the rotor 14 at a certain interval in the circumferential direction C, the multiple compressor rotor blade units 23 being fixed to the outer circumference of the rotor 14 at a certain interval in the axial direction. This configuration enables the compressor 11 to prevent the leakage air from flowing out without increasing the structural complexity or the manufacturing cost, and can prevent the pressure loss.

The gas turbine according to the present embodiment includes the compressor 11, the combustor 12 that mixes the compressed air compressed by the compressor 11 with a fuel and burns the mixture, and the turbine 13 rotationally driven by combustion gas generated by the combustor 12. This configuration enables the gas turbine 10 to prevent the leakage air from flowing out without increasing the structural complexity or the manufacturing cost, and can prevent the pressure loss.

REFERENCE SIGNS LIST

10 Gas turbine
11 Compressor
12 Combustor
13 Turbine
14 Rotor (rotation shaft)
15 Generator
21 Casing
21*a* Inner circumferential surface
22 Compressor stator vane unit
23 Compressor rotor blade unit
31 Compressor stator vane
31*a* Leading edge (edge)
31*b* Trailing edge
32 Shroud (joint member)
33 Compressor rotor blade
34 Disk
35 Main gas flow path
36 Platform
37 Cavity (leakage fluid flow path)
38 First leakage air flow path (leakage fluid flow path)
39 Second leakage air flow path (leakage fluid flow path)
40 Labyrinth seal (seal member)
D Opening distance
P Compressor stator vane pitch
T Compressor stator vane maximum thickness
E Chord length
H High-pressure space
L Low-pressure space
A Axial direction
A1 Air flow direction
C Circumferential direction
R Radial direction
L1 Air intake line
L2 Compressed air feed line
L3 Fuel gas feed line
L4 Combustion gas feed line
L5 Exhaust gas line

The invention claimed is:

1. A compressor comprising:
a casing;
a rotation shaft disposed in and rotatably supported by the casing;
a plurality of compressor stator vane units, the plurality of compressor stator vane units being fixed to an inner circumferential surface of the casing at a certain interval in the axial direction of the rotation shaft; and
a plurality of compressor rotor blade units fixed to an outer circumference of the rotation shaft at a certain interval in the axial direction of the rotation shaft, and each of the plurality of compressor rotor blade units includes a plurality of compressor rotor blades fixed to the outer circumference of the rotation shaft at a certain interval in a circumferential direction,
wherein each of the compressor stator vane units comprises:
a compressor stator vane; and
an annular joint member connected with an inner end of the compressor stator vane;
wherein the annular joint member constitutes an outer diameter side surface of a leakage fluid flow path provided in an inner diameter side of the annular joint member, and the leakage fluid flow path being configured to allow a high-pressure space located downstream of the compressor stator vane in a fluid flow direction to communicate with a low-pressure space located upstream of the compressor stator vane in the fluid flow direction, and
wherein a relationship D/P is set to a range: $0.05 \leq D/P \leq 0.2$, wherein D is defined as a distance in an axial direction between an upstream end surface of the annular joint member in the fluid flow direction and an upstream edge of the compressor stator vane in the fluid flow direction, and P is defined as a pitch between the compressor stator vane and another adjacent compressor stator vane in the circumferential direction.

2. A gas turbine comprising:
the compressor according to claim 1;
a combustor configured to mix compressed air compressed by the compressor with a fuel to burn the mixture; and
a turbine configured to be rotationally driven by combustion gas generated by the combustor.

3. The gas turbine according to claim 2, wherein a rated speed of the gas turbine is set to a range from 2500 rpm to 4000 rpm.

4. The gas turbine according to claim 2, wherein the gas turbine is configured such that a velocity of fluid flowing in the axial direction through a region between the compressor stator vane and a second compressor stator vane adjacent to the compressor stator vane in the circumferential direction at a rated speed range is set to a range from 50 m/s to 200 m/s.

5. The compressor according to claim 1, wherein D/P is set to a range: $0.06 \leq D/P \leq 0.18$.

6. A compressor comprising:
a casing;
a rotation shaft disposed in and rotatably supported by the casing;
a plurality of compressor stator vane units, the plurality of compressor stator vane units being fixed to an inner circumferential surface of the casing at a certain interval in the axial direction of the rotation shaft; and
a plurality of compressor rotor blade units fixed to an outer circumference of the rotation shaft at a certain interval in the axial direction of the rotation shaft, and each of the plurality of compressor rotor blade units includes a plurality of compressor rotor blades fixed to the outer circumference of the rotation shaft at a certain interval in a circumferential direction wherein each of the compressor stator vane units comprises:

a compressor stator vane; and an annular joint member connected with an inner end of the compressor stator vane;

wherein the annular joint member constitutes an outer diameter side surface of a leakage fluid flow path provided in an inner diameter side of the annular joint member, and the leakage fluid flow path being configured to allow a high-pressure space located downstream of the compressor stator vane in a fluid flow direction to communicate with a low-pressure space located upstream of the compressor stator vane in the fluid flow direction, wherein a relationship D/T is set to a range: $0.3 \leq D/T \leq 1.2$, wherein D is defined as a distance in an axial direction between an upstream end surface of the annular joint member in the fluid flow direction and an upstream edge of the compressor stator vane in the fluid flow direction, and T is defined as a maximum thickness of the compressor stator vane.

7. The compressor according to claim 6, wherein D/T is set to a range: $0.4 \leq D/T \leq 1.1$.

* * * * *